US008905728B2

(12) United States Patent
Blankemeier et al.

(10) Patent No.: US 8,905,728 B2
(45) **Date of Patent: *Dec. 9, 2014**

(54) ROTODYNAMIC PUMP WITH PERMANENT MAGNET COUPLING INSIDE THE IMPELLER

(75) Inventors: William R. Blankemeier, Oak Park, IL (US); Radosav Trninich, Bridgeview, IL (US)

(73) Assignee: Peopleflo Manufacturing, Inc., Franklin Park, IL (US)

( * ) Notice: Subject to any disclaimer, the term of this patent is extended or adjusted under 35 U.S.C. 154(b) by 404 days.

This patent is subject to a terminal disclaimer.

(21) Appl. No.: 13/340,779

(22) Filed: Dec. 30, 2011

(65) Prior Publication Data

US 2013/0171011 A1 Jul. 4, 2013

(51) Int. Cl.
*F04D 13/02* (2006.01)
*F04D 29/041* (2006.01)

(52) U.S. Cl.
USPC ..... 417/420; 417/423.12; 417/423.14; 417/365; 277/630; 277/637; 277/641; 277/642; 277/643

(58) Field of Classification Search
CPC ..... F04D 13/24; F04D 13/25; F04D 13/26
USPC ..... 417/410.1, 420, 423.12, 423.14, 365; 277/628, 630, 637, 641, 642, 643; 310/103
See application file for complete search history.

(56) References Cited

U.S. PATENT DOCUMENTS 3,107,310 A * 10/1963 Carriere et al. ..... 310/103
4,184,090 A 1/1980 Taiani et al.
4,645,433 A 2/1987 Hauenstein
4,648,808 A 3/1987 Hauenstein
4,793,777 A 12/1988 Hauenstein
4,836,147 A 6/1989 Morris
5,324,177 A * 6/1994 Golding et al. ..... 417/423.1
5,370,509 A 12/1994 Golding et al.
5,407,331 A * 4/1995 Atsumi ..... 417/420
5,501,582 A 3/1996 Gautier et al.

(Continued)

FOREIGN PATENT DOCUMENTS

JP 2009074434 A 4/2009
JP 2009254436 A 11/2009
WO WO 2008/000506 A1 1/2008
WO WO 2008000506 A1 * 1/2008

OTHER PUBLICATIONS

International Search Report for PCT/US2012/070932 dated Mar. 13, 2013.

(Continued)

*Primary Examiner* — Devon Kramer
*Assistant Examiner* — Nathan Zollinger
(74) *Attorney, Agent, or Firm* — Cook Alex Ltd.

(57) ABSTRACT

Rotodynamic pumps having an inner drive permanent magnet coupling disposed inside an impeller are provided. The impeller has a casing having a pumping region generally in a pumping plane that is perpendicular to the rotational axis of the impeller and aligned with a permanent magnet coupling that includes outer magnets that are connected to the impeller and at least partially aligned with the pumping region of the impeller, and inner magnets that are connected to an inner magnet ring and are axially aligned with the outer magnets. A canister is sealed to the casing and separates the outer magnets from the inner magnets.

22 Claims, 5 Drawing Sheets

(56) References Cited

U.S. PATENT DOCUMENTS

| | | | | |
|---|---|---|---|---|
| 6,280,156 | B1 | 8/2001 | Wirz et al. | |
| 7,146,822 | B2 | 12/2006 | Stewart | |
| 7,707,720 | B2 | 5/2010 | Klein et al. | |
| 2003/0072656 | A1 | 4/2003 | Niwatsukino et al. | |
| 2003/1007265 | | 4/2003 | Niwatsukino et al. | |
| 2003/0124007 | A1 | 7/2003 | Schima et al. | |
| 2003/0139643 | A1* | 7/2003 | Smith et al. | 600/16 |
| 2004/0234395 | A1 | 11/2004 | Hatano | |
| 2004/0236420 | A1* | 11/2004 | Yamane et al. | 623/3.14 |
| 2005/0012411 | A1 | 1/2005 | Hoffman et al. | |
| 2007/0280841 | A1 | 12/2007 | LaRose et al. | |
| 2010/0028176 | A1 | 2/2010 | Platt | |
| 2010/0280305 | A1 | 11/2010 | Hidaka et al. | |

OTHER PUBLICATIONS

Written Opinion of the International Searching Authority for PCT/US2012/070932 dated Mar. 13, 2013.

International Search Report for PCT/US2012/070923 dated Mar. 1, 2013.

Written Opinion of the International Searching Authority for PCT/US/2012/070923 dated Mar. 1, 2013.

International Search Report for PCT/US2012/070923 dated Mar. 13, 2013.

Written Opinion of the International Searching Authority for PCT/US/2012/070923 dated Mar. 13, 2013.

* cited by examiner

ROTODYNAMIC PUMP WITH PERMANENT MAGNET COUPLING INSIDE THE IMPELLER

BACKGROUND OF THE INVENTION

1. Field of the Invention

The present invention generally relates to rotodynamic or centrifugal pumps, and more particularly to permanent magnet coupling pumps.

2. Discussion of the Prior Art

In many pumping applications, it is desirable to avoid rotating seals. Rotodynamic pumps have been developed with a magnet coupling that utilizes an impeller that is driven via a non-contacting permanent magnet coupling in a radial magnet orientation. Such pumps frequently are referred to as being sealless, but actually include inner and outer magnets separated by a canister that is sealed with a static seal. Permanent magnet coupled rotodynamic pumps typically are of one of three types, separately coupled, close coupled or vertical submerged.

Separately coupled permanent magnet coupled rotodynamic pumps generally utilize end suction via an axial inlet, are of single stage or multistage configuration, and include an overhung impeller design. The overhung impeller design has the impeller mounted on a rotor assembly which contains a first magnet ring of a magnet coupled drive spaced from the pumping element. A second magnet ring is mounted on the rotatable shaft of a frame that is coupled to a motor or power drive device. The pump, the frame that supports the rotatable shaft, and the power drive device generally are mounted on a common base plate.

Close coupled permanent magnet coupled rotodynamic pumps tend to be of a somewhat similar construction to the separately coupled version, except that the second magnet ring is mounted directly on the driver shaft of the power drive device.

Vertical submerged permanent magnet coupled rotodynamic pumps generally also are of somewhat similar construction to the separately couple version, but the impeller is mounted on the lower end of an elongated shaft which is overhung from its drive bearing supports. The drive section utilizes permanent magnets or an eddy current drive system to transmit power to the elongated shaft and impeller. This type of sealless pump uses a standard motor to drive the second magnet ring, which in turn drives the first magnet ring. A containment shell or canister that contains the process fluid sealingly separates the magnet components. The containment shell in the drive permits pumping from a sealed vessel using a submergible pump.

Radial magnetic couplings that utilize permanent magnets are common in each of the above rotodynamic (aka kinetic, centrifugal) pumps. The radial magnetic couplings consist of three main components: a larger, outer coupling component (aka an outer magnet or outer rotor) with multiple permanent magnets on its inner surface; a smaller, inner coupling component (aka an inner magnet or inner rotor) with multiple permanent magnets on its outer surface; and a containment canister (aka a can, shell, shroud, or barrier) separating the inner and outer components and forming a boundary for the fluid chamber. The magnets on the inner and outer components are disposed in alignment with each other to match up and synchronize the inner and outer components, such that as one component is rotated, the other component is synchronized and forced to follow, whereby the pump impeller or pumping rotor is driven. But neither of the inner or outer coupling components physically touches the other, and they rotate in separate environments, separated by the canister.

The radial magnetic couplings are of two configurations, "outer drive" and "inner drive". Most radial magnetic couplings in rotodynamic pumps have an outer drive arrangement in which the outer coupling component is outside of the pump's fluid chamber, and usually is driven by an external power source, such as a motor. In such configurations, the inner coupling component is disposed inside the pump's fluid chamber and is connected to the impeller. The containment canister provides the boundary of the pump's fluid chamber, with the fluid chamber being inside of the canister.

Although less common, some pumps have an inner drive arrangement, which utilizes the same three general components, but the roles are reversed. The inner coupling component is outside of the pump's fluid chamber, and usually is driven by an external power source, such as a motor, while the outer coupling component is inside the pump's fluid chamber and is connected to the impeller. A containment canister again provides the boundary of the pump's fluid chamber, with the fluid chamber being outside of the canister. All of the inner drive rotodynamic pumps known to the inventors have a common configuration with respect to the location of the impeller relative to the magnetic coupling, with the impeller being positioned axially forward of the magnetic coupling.

With the impeller being positioned forward of the magnetic coupling, such inner drive pumps have several disadvantages. The pumps are rather large, given that the axial space for the impeller is separate and forward of the axial space for the magnetic coupling. The relatively large pumps further require large and more expensive components, a large volume of space for mounting, and such pumps are heavier and more difficult to handle. The inner drive pumps also often experience an impeller thrust imbalance. The impeller is subjected to a high forward thrust load, due to the higher discharge pressure acting upon a relatively large rear surface of the impeller.

The prior art pumps also tend to have additional internal cavities where fluid can stagnate and which often must be flushed out between usages. In addition, the prior art pumps do not provide very effective cooling for the canister, because the canister is not directly exposed to the incoming cool liquid that enters the pump through the inlet port. Canister cooling for such pumps is particularly important when the canister is made from electrically conductive materials, because such materials generate eddy current heating when the magnetic coupling is rotating.

Many of the existing inner drive permanent magnet coupled pump designs include an internal recirculation path, which allows a small amount of pumped fluid to flow from a higher pressure area (near the discharge port) to a lower pressure area (near the inlet port). Such a recirculation path serves three purposes: to prevent stagnation or solids accumulation within the pump; to improve cooling and/or lubrication of the impeller support bearings; and to improve cooling of the canister. The last purpose only applies when the canister is made of electrically conductive material and is subjected to eddy current heating when the magnetic coupling is rotating.

The details of existing recirculation paths vary widely among different pump designs and incorporate many different section designs. However, such internal recirculation paths tend to be rather complex, because they need to flow through a magnet chamber located deep behind the impeller. The internal recirculation paths often include some sections where all the surfaces are stationary. The stationary sections more easily allow product stagnation and/or accumulation of solids.

Many of the existing inner drive permanent magnet coupled pump designs include an internal recirculation path, which allows a small amount of pumped fluid to flow from a higher pressure area (near the outlet port) to a lower pressure area (near the inlet port). Such a recirculation path serves three purposes: to prevent stagnation or solids accumulation within the pump; to improve cooling and/or lubrication of the impeller support bearings; and to improve cooling of the canister. The last purpose only applies when the canister is made of electrically conductive material and is subjected to eddy current heating when the magnetic coupling is rotating.

SUMMARY OF THE INVENTION

The purpose and advantages of the disclosed subject matter will be set forth in and apparent from the description and drawings that follow, as well as will be learned by practice of the claimed subject matter.

The present disclosure generally provides a rotodynamic pump with a radial, inner drive permanent magnet coupling disposed inside of an impeller. The rotodynamic pump has a casing defining a pumping cavity, an inlet port connected to the pumping cavity, and a discharge port connected to the pumping cavity. The pump has an impeller being rotatable about a rotational axis and disposed within the pumping cavity, the impeller having a pumping region generally in a pumping plane that is perpendicular to the rotational axis and aligned with a permanent magnet coupling that includes outer magnets that are connected to the impeller and at least partially aligned with the pumping region of the impeller. The pump also includes inner magnets that are connected to an inner magnet ring and are axially aligned with the outer magnets. The pump also includes a canister that is sealed to the casing and separates the outer magnets from the inner magnets.

Thus, all or part of the magnet coupling inside the impeller is disposed within the pumping plane and is axially aligned with the pumping region of the impeller. As such, the impeller has a large central opening for the magnet coupling and the outer magnets are disposed within the central opening and connected to the impeller.

The present disclosure further provides a permanent magnet coupling in a rotodynamic pump that includes an internal circulation cooling flow path between the canister and the impeller. The internal circulation cooling flow path allows a small amount of pumped fluid to flow from a higher pressure area near the discharge port to a lower pressure area near the inlet port. The details of the path sections can vary, but the disclosure includes preferred sections. The first section is a chamber behind the impeller that is disposed between the impeller and a canister flange. The second section includes grooves in surfaces of a rear bushing. The third section includes a gap between the outer magnets and the canister. Some embodiments include a fourth section having grooves in surfaces of a front bushing. Such cooling paths avoid stagnation and accumulation of solids, while also permitting ready and more complete flushing of the entire pump when utilized in applications that require pumps to be flushed between uses.

The present disclosure generally provides a rotodynamic pump with a radial, inner drive permanent magnet coupling disposed inside of an impeller. The rotodynamic pump has a casing defining a pumping cavity, an inlet port connected to the pumping cavity, and an outlet port connected to the pumping cavity. The pump has an impeller being rotatable about a rotational axis and disposed within the pumping cavity, the impeller having a pumping region generally in a pumping plane that is perpendicular to the rotational axis and aligned with a permanent magnet coupling that includes outer magnets that are connected to the impeller and at least partially aligned with the pumping region of the impeller. The pump also includes inner magnets that are connected to an inner magnet ring and are axially aligned with the outer magnets. The pump also includes a canister that is sealed to the casing and separates the outer magnets from the inner magnets.

The magnet coupling also may include some variations, such as being of a short profile that fits entirely within the length of the pumping region of the impeller or being a bit longer and having a portion of the magnet coupling within the length of the pumping region of the impeller. Applications having higher torque requirements may be addressed with use of such longer couplings where the magnet coupling may be at least partially disposed within the pumping region of the impeller. In addition, the canister may be of a multi-part or single part construction.

The present disclosure further provides a permanent magnet coupling in a rotodynamic pump that includes an internal circulation cooling flow path between the canister and the impeller. The internal circulation cooling flow path allows a small amount of pumped fluid to flow from a higher pressure area near the outlet port to a lower pressure area near the inlet port. The details of the path sections can vary, but the disclosure includes preferred sections. The first section is a chamber behind the impeller that is disposed between the impeller and a canister flange. The second section includes grooves in surfaces of a rear bushing. The third section includes a gap between the outer magnets and the canister. Some embodiments include a fourth section having grooves in surfaces of a front bushing. Such cooling paths avoid stagnation and accumulation of solids, while also permitting ready and more complete flushing of the entire pump when utilized in applications that require pumps to be flushed between uses.

Another potential advantage is that pumps using the subject matter of the present disclosure have fewer internal cavities where fluid can stagnate. This is especially advantageous in applications where such stagnation causes problems, such as when batch cross-contamination must be minimized, or in hygienic applications, where microbial growth must be prevented, and in any applications where the pumps must be flushed out completely between usages.

A further advantage can be realized in that the designs can provide exceptionally effective cooling for the canister, through the end portion of the canister, which is directly exposed to the cool liquid entering the pump through the inlet port. Canister cooling can be particularly important when the canister is made from electrically conductive materials, because such materials generate eddy current heating when the magnetic coupling is rotating.

Other potential advantages include that the pumps have an internal circulation path that is very simple and effective, because there is no deep chamber behind the impeller through which the fluid must circulate. Also, the internal circulation path is completely dynamic, such that no sections of the path consist of totally stationary surfaces. Thus, it is advantageous that pumps avoid having stationary sections of circulation cooling paths that more easily allow product stagnation and/or accumulation of solids.

A further advantage is that the net thrust load on the impeller is easier to balance than with typical designs, because of the large opening in the center of the impeller. The large opening reduces the surface area of both the front and rear of the impeller. Given that the higher discharge pressure acts upon the rear surface area of the impeller and creates a forward thrust load, the reduced rear surface area in this design reduces the forward thrust load. Similarly, the pressure exerted in the inlet port by the fluid entering the pump acts on the reduced front surface area of the impeller, reducing the rearward load applied to the impeller. The net effect is a reduction in forward thrust, because the discharge pressure is higher than the inlet pressure. The net thrust load on typical impellers is forward, and the reduced forward load helps to balance the thrust load on the impeller. A more balanced impeller thrust load is advantageous for pump wear life and it may avoid the need for heavy-duty thrust bearings.

It is to be understood that both the foregoing general description and the following detailed description are exemplary and provided for purposes of explanation only, and are not restrictive of the subject matter claimed. Further features and objects of the present disclosure will become more fully apparent in the following description of the preferred embodiments and from the appended claims.

BRIEF DESCRIPTION OF THE DRAWINGS

In describing the preferred embodiments, reference is made to the accompanying drawing figures wherein like parts have like reference numerals, and wherein.

It should be understood that the drawings are not to scale. While some mechanical details of a rotodynamic pump with permanent magnet coupling inside the impeller, including details of fastening means and other plan and section views of the particular components, have not been included, such details are considered well within the comprehension of those of skill in the art in light of the present disclosure. It also should be understood that the present invention is not limited to the example embodiments illustrated.

DETAILED DESCRIPTION OF THE PREFERRED EMBODIMENTS

Referring generally to FIGS. 1-5, it will be appreciated that rotodynamic pumps with a permanent magnet coupling inside the impeller of the present disclosure generally may be embodied within numerous configurations of rotodynamic or centrifugal pumps. Indeed, while acknowledging that all of the example configurations that may include a permanent magnet inner drive need not be shown herein, it is contemplated that the permanent magnet inner drive systems may be incorporated into various rotodynamic pumps. To demonstrate this position, a few examples of pump configurations are shown herein.

Figure 1:
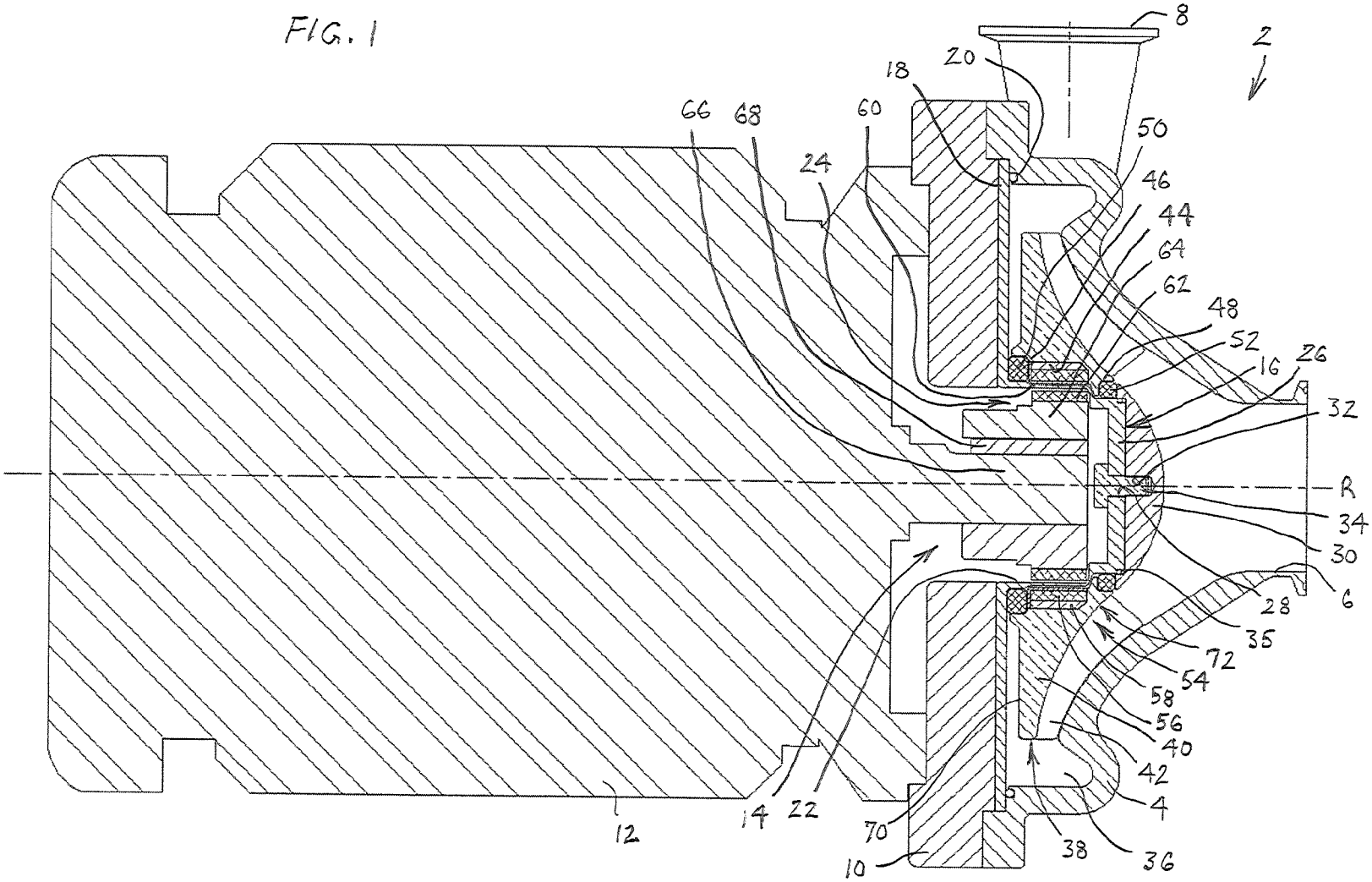
FIG. 1 is a cross-sectional view of a first example of a rotodynamic pump having a relatively short permanent magnet coupling within an impeller, with an inner drive having a close coupled motor drive, mixed flow, a partial shroud, metallic fluid contact surfaces, and a canister of multi-part construction.
Figure 2:
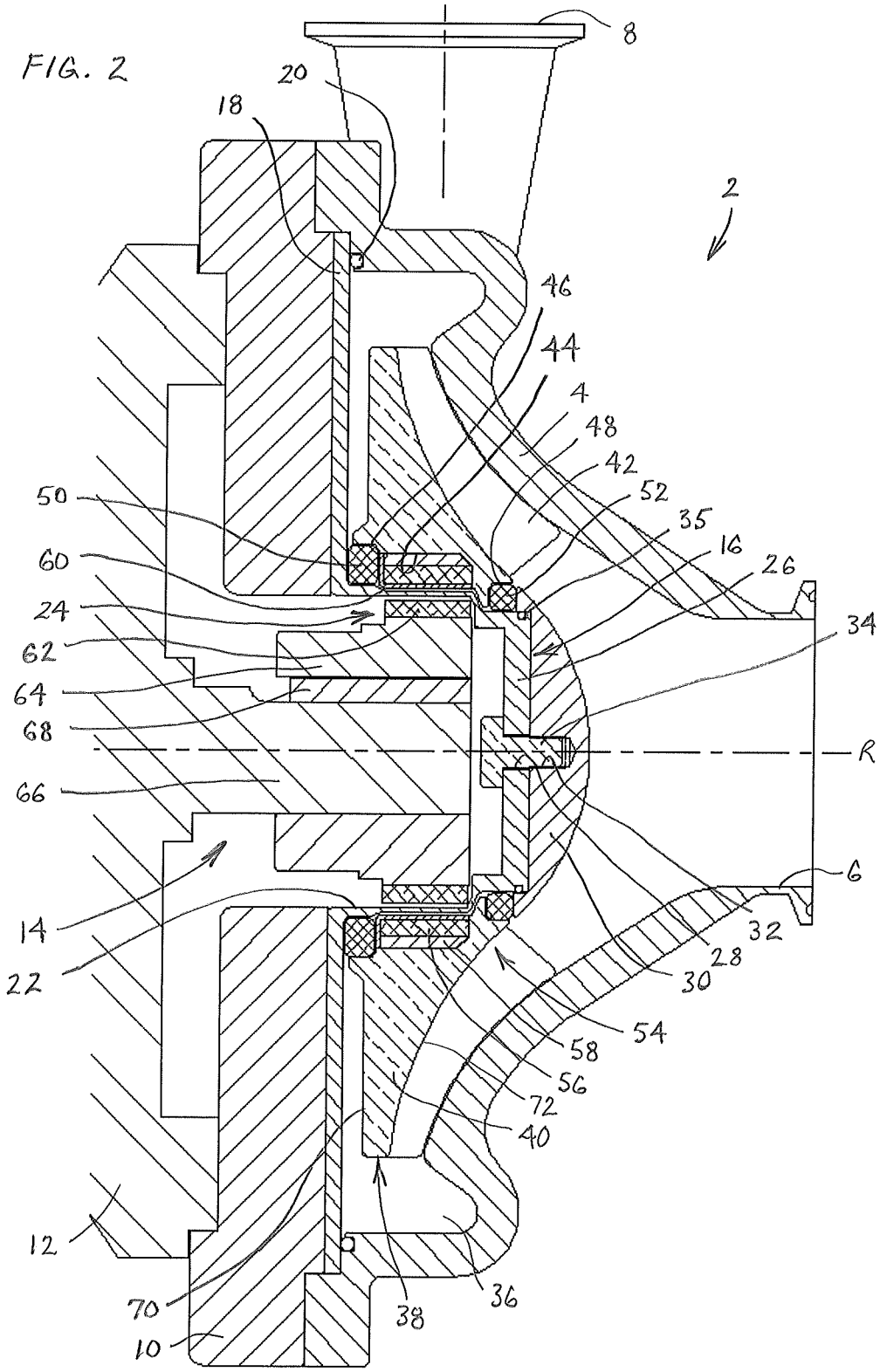
FIG. 2 is an enlarged cross-sectional view of the pump portion shown in FIG. 1.
Figure 3:
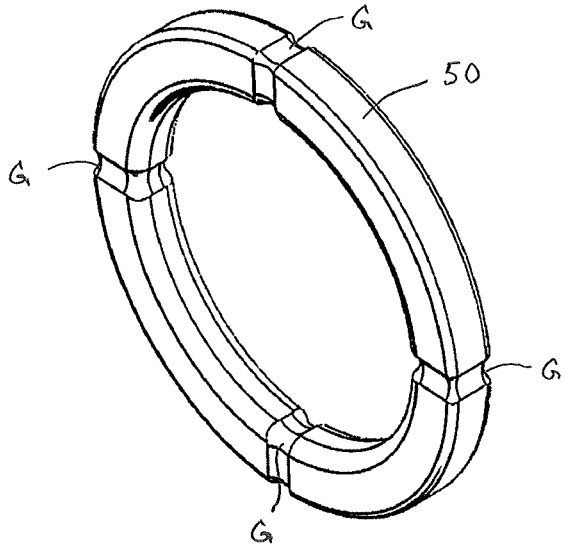
FIG. 3 is a perspective view of a thrust bearing shown in FIG. 1.

Turning to a first example embodiment in FIGS. 1-3, a rotodynamic pump 2 includes a casing 4 with an inlet port 6, and an outlet port 8. The casing 4 may be constructed of rigid materials, such as steel, stainless steel, cast iron or other metallic materials, or structural plastics or the like. However, it will be appreciated that the casing and all surfaces that contact the fluid that will flow through the pump may present a non-metallic surface, such as by use of a liner or application of a non-metallic coating.

The casing 4 is connected to an adapter 10, which facilitates mounting to a motor 12 for a close-coupled drive configuration 14. Disposed in sealing engagement between the adapter 10 and the casing 4 is a canister 16 having a peripheral radial flange 18 that is sealed to the casing 4 by a first static seal 20. The static seal 20 may be constructed as an elastomeric o-ring, or preformed or liquid gasket materials or the like, which may be employed to enhance the connection between the components.

The canister 16 further includes a cylindrical portion 22 that has a rear opening 24, and a front end portion 26. The end portion 26 has a central aperture 28. The peripheral radial flange 18, cylindrical portion 22 and end portion 26 of the canister 16 may be constructed of any of a variety of rigid materials, and the material is typically chosen based on the medium to be pumped, but preferably is non-magnetic and constructed of stainless steel, such as alloy C-276, or of plastic, composite materials or the like. The canister 16 may be integrally fabricated from a single piece or may be fabricated, such as by welding together separately formed portions. A nose cone 30 has a threaded bore 32 that receives a fastener 34, such as a bolt, that passes through the aperture 28 in the end portion 26 of the canister 16 to connect the nose cone 30 to the canister 16. The nose cone 30 also is sealed to the canister 16 by a second static seal 35 that may be of similar construction to the first static seal 20.

The casing 4, the canister 16 and the nose cone 30 define an interior pumping cavity 36 that is in communication with the inlet port 6 and outlet port 8. An impeller 38 is disposed within the interior pumping cavity 36 and includes an impeller body 40 and vanes 42 extending therefrom, with a pumping region indicated by the axial length of the vanes 42. The impeller 38 has a partially shrouded construction and provides mixed axial and radial flow. It is desirable for the impeller 38 to have some form of thrust bearing surfaces. The impeller body 40 has a central opening 44 that includes a rear well 46 that together with an overlying magnet protection sleeve 60, discussed below, provides first axial and radial thrust bearing surfaces, and a front well 48 that provides second axial and radial thrust bearing surfaces. The first well 46 receives a rear bushing 50 and the second well 48 receives a front bushing 52. Alternative or additional provision for rearward and/or forward thrust bearings also may be employed, and thrust bearings may be integrally or separately provided to retain appropriate positioning of components to reduce vibration and wear. In this example, the impeller 38 is rotatably coupled to the canister 16 via the bushings 50, 52, that engage the thrust bearing surfaces provided by the rear and front wells 46, 48, and the impeller 38 rotates about a rotational axis R. Alternatives to the bushings 50, 52 may be utilized and the bushings could be initially fixed to or otherwise engage the canister 16 or the impeller 38 during assembly of the pump 2.

To drive the impeller 38 in this first example pump 2, a permanent magnet coupling 54 is disposed within the central opening 44. The permanent magnet coupling 54 includes outer permanent magnets 56 connected to an outer magnet ring 58 that preferably is constructed of magnetic material and is disposed in the central opening 44 and connected to the impeller 38. Outer magnets 56 may be of any configuration, but are preferably rectangular and are preferably connected to the outer magnet ring 58 by chemical means, such as by epoxy or adhesives, or may be attached by suitable fasteners, such as by rivets or the like, with the magnets 56 being protected from the pumped fluid by a thin magnet protection sleeve 60 that, in this example, provides protection in both the axial and radial directions. The outer magnets 56 are at least partially axially aligned with the pumping region of the impeller 38. Thus, a plane that is perpendicular to the rotational axis of the impeller 38, and that passes through the pumping region and at least a portion of the permanent magnet coupling 54, may for convenience be referred to as a pumping plane.

The permanent magnet coupling 54 further includes inner permanent magnets 62 connected to an inner magnet ring 64 that is in the configuration of a hub that is connected to a shaft 66 on the drive motor 12 by a key 68. The inner magnets 62 are in close proximity to, axially aligned with, but separated from the outer magnets 56 by the relatively thin-walled cylindrical portion 22 of the canister 16. When the shaft 66 of the drive motor 12 rotates, it causes the inner magnets 62 to rotate which, via a magnetic coupling with the outer magnets 56, causes the impeller 38 to rotate.

As best seen in FIG. 2, the impeller 38 has a rear surface 70 that is exposed to the discharged fluid that is under pressure. The forward thrust load generated by the discharge pressure on the rear surface 70 is at least partially balanced by the pressure of the fluid entering the inlet port 6 and engaging the front surface 72 of the impeller 38. The forward and rearward thrust loads on the impeller 38 may be balanced to a preselected degree. In turn, fluid under the higher discharge pressure is used in a circulation path to cool the canister 16, bushings 50, 52, and magnets 56, 62.

To drive the impeller 38 in this first example pump 2, a permanent magnet coupling 54 is disposed within the central opening 44. The permanent magnet coupling 54 includes outer permanent magnets 56 connected to an outer magnet ring 58 that preferably is constructed of magnetic material and is disposed in the central opening 44 and connected to the impeller 38. Outer magnets 56 may be of any configuration, but are preferably rectangular and are preferably connected to the outer magnet ring 58 by chemical means, such as by epoxy or adhesives, or may be attached by suitable fasteners, such as by rivets or the like, with the magnets 56 being protected from the pumped fluid by a thin magnet protection sleeve 60 that, in this example, provides protection in both the axial and radial directions. The outer magnets 56 are at least partially axially aligned with the pumping region of the impeller 38. Thus, an imaginary plane that is perpendicular to the rotational axis of the impeller 38, and that passes through the pumping region and at least a portion of the permanent magnet coupling 54, may for convenience be referred to as a pumping plane.

The close-coupled drive configuration 14 and connection of the inner magnet ring 64 to the shaft 66 of the drive motor 12 allows for a shorter length, more space efficient and lighter weight, drive and pump installation. This is further enhanced by the relatively short magnet coupling 54 that is within the pumping region of the impeller 16, generally in a pumping plane that is perpendicular to the rotational axis R of the impeller 38.

Figure 4:
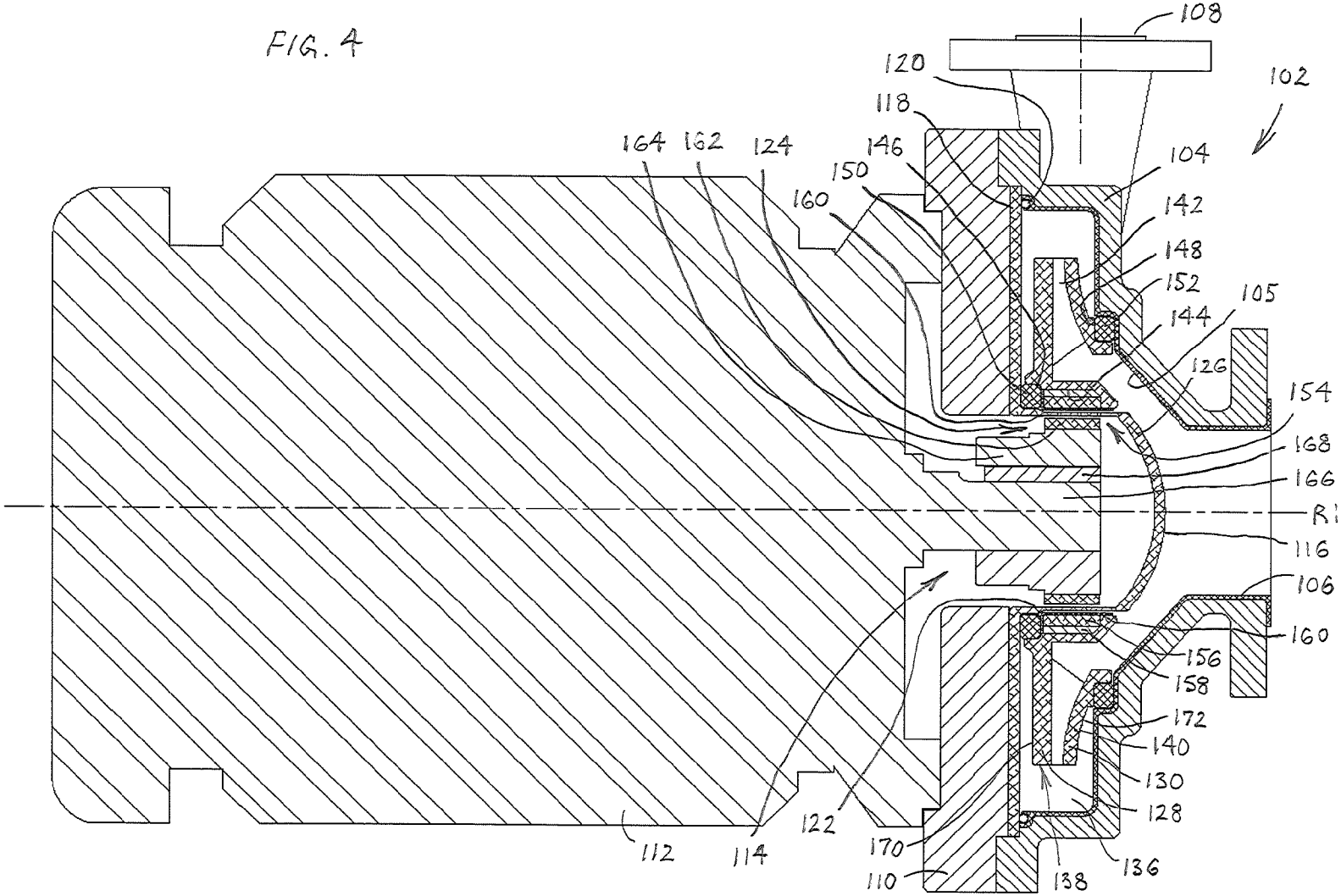
FIG. 4 is a cross-sectional view of a second example of a rotodynamic pump having a relatively short permanent magnet coupling within an impeller, with an inner drive having a close coupled motor drive, radial flow, a full shroud, non-metallic fluid contact surfaces, and a canister of single part construction.

Turning to a second example embodiment in FIG. 4, a rotodynamic pump 102 includes a casing 104 with an inlet port 106, and an outlet port 108. The casing 104 may be constructed of rigid materials, such as were described for the first example. In this example, the casing 104 also includes a non-metallic liner 105 to provide non-metallic surfaces that contact the fluid that will flow through the pump. This may present interior surfaces having surface finishes that are acceptable for particular applications.

The casing 104 is connected to an adapter 110, which facilitates mounting to a motor 112 for a close-coupled drive configuration 114. Disposed in sealing engagement between the adapter 110 and the casing 104 is a canister 116 having a peripheral radial flange 118 that is sealed to the casing 104 by a first static seal 120. The static seal 120 may be constructed in a similar manner to that described above with respect to the first example embodiment. The canister of any of the examples also may be constructed with surface finishes in the interior of the pump that are acceptable for use in hygienic applications, such as by use of non-metallic or highly polished suitable metallic finishes.

The canister 116 further includes a cylindrical portion 122 that has a rear opening 124, and a front end portion 126. The end portion 126 presents a convex surface to the fluid that enters through the inlet port 106 to avoid turbulence. The end portion 126 effectively presents a nose cone that is a part of the sealed structure of the canister 116. The peripheral radial flange 118, cylindrical portion 122 and end portion 126 of the canister 116 are configured as a single piece and may be constructed of any of a variety of rigid materials, and in any suitable manner, such as described above with respect to the first example embodiment.

The casing 104 and the canister 116 define an interior pumping cavity 136 that is in communication with the inlet port 106 and outlet port 108. An impeller 138 is disposed within the interior pumping cavity 136 and includes an impeller body 140 and vanes 142 extending therefrom. The impeller 138 is constructed with a rear shroud 128 and a front shroud 130 and provides radial flow. It is desirable for the impeller 138 of this example to have some form of thrust bearing surfaces. The impeller body 140 has a central opening 144 that includes a rear well 146 that together with an overlying magnet protection sleeve 160, discussed below, provides first axial and radial thrust bearing surfaces, and a front well 148 that provides second axial and radial thrust bearing surfaces. The first well 146 receives a rear bushing 150 and the second well 148 receives a front bushing 152. Alternative or additional provision for rearward and/or forward thrust bearings also may be employed, and thrust bearings may be integrally or separately provided to retain appropriate positioning of components to reduce vibration and wear. In this second example, the impeller 138 is rotatably coupled to the canister 116 via the bushings 150, 152, that engage the thrust bearing surfaces provided by the rear and front wells 146, 148, and the impeller 138 rotates about a rotational axis R1. As noted above, alternative bushing configurations may be utilized and the bushings could be initially fixed to or otherwise engage the canister 116 or the impeller 138 during assembly of the pump 102.

To drive the impeller 138 in this second example pump 102, a permanent magnet coupling 154 is disposed within the central opening 144. The permanent magnet coupling 154 includes outer permanent magnets 156 connected to an outer magnet ring 158 that preferably is constructed of magnetic material and is disposed in the central opening 144 and connected to the impeller 138. Outer magnets 156 may be of any configuration, but are preferably rectangular and are preferably connected to the outer magnet ring 158 in a manner such as described with respect to the first example embodiment. The magnets 156 also may be protected from the pumped fluid by a thin magnet protection sleeve 160 that, similarly to the first example, provides protection in both the axial and radial directions. The outer magnets 156 are at least partially axially aligned with the pumping region of the impeller 138.

The permanent magnet coupling 154 further includes inner permanent magnets 162 connected to an inner magnet ring 164 that is in the configuration of a hub that is connected to a shaft 166 on the drive motor 112 by a key 168. The inner magnets 162 are in close proximity to, axially aligned with, but separated from the outer magnets 156 by the relatively thin-walled cylindrical portion 122 of the canister 116. When the shaft 166 of the drive motor 112 rotates, it causes the inner magnets 162 to rotate which, via a magnetic coupling with the outer magnets 156, causes the impeller 138 to rotate.

As seen in FIG. 4, the impeller 138 has a rear surface 170 that is exposed to the discharged fluid that is under pressure. The forward thrust load generated by the discharge pressure on the rear surface 170 is at least partially balanced by the pressure of the fluid entering the inlet port 106 and engaging the front surface 172 of the impeller 138. As with the prior example, the forward and rearward thrust loads on the impeller 138 may be balanced to a preselected degree. In turn, fluid under the higher discharge pressure is used in a circulation path to cool the canister 116, bushings 150, 152 and magnets 156, 162. The circulation path for this example includes three sections, the first being a chamber behind the rear surface 170 of the impeller 138 through which fluid flows under pressure. The fluid flows from the first section to the second, which is formed by the rear bushing 150 having grooves, such as are shown in FIG. 3 in the rear bushing 50 of the first example embodiment. The fluid further flows through the third section of the circulation path which includes the gap between the cylindrical portion 122 of the canister 116 and the protection sleeve 160 over the outer magnets 156. The fluid flow then rejoins the fluid entering the pumping cavity 136 through the inlet port 106. Thus, the rear and front bushings 150, 152 are of a similar configuration to the rear bushing of the first example, shown in a perspective view in FIG. 3. Still further cooling is promoted by the fluid entering the inlet port 106 and engaging the front end portion 126 of the canister 116.

As with the first example pump 2, in this second example 102, the close-coupled drive configuration 114 and connection of the inner magnet ring 164 to the shaft 166 of the drive motor 112 allows for a shorter, more space efficient and lighter weight, drive and pump installation. This is further enhanced by the relatively short magnet coupling 154 that is within the pumping region of the impeller 138, generally in a pumping plane that is perpendicular to the rotational axis R1 of the impeller 138.

Figure 5:
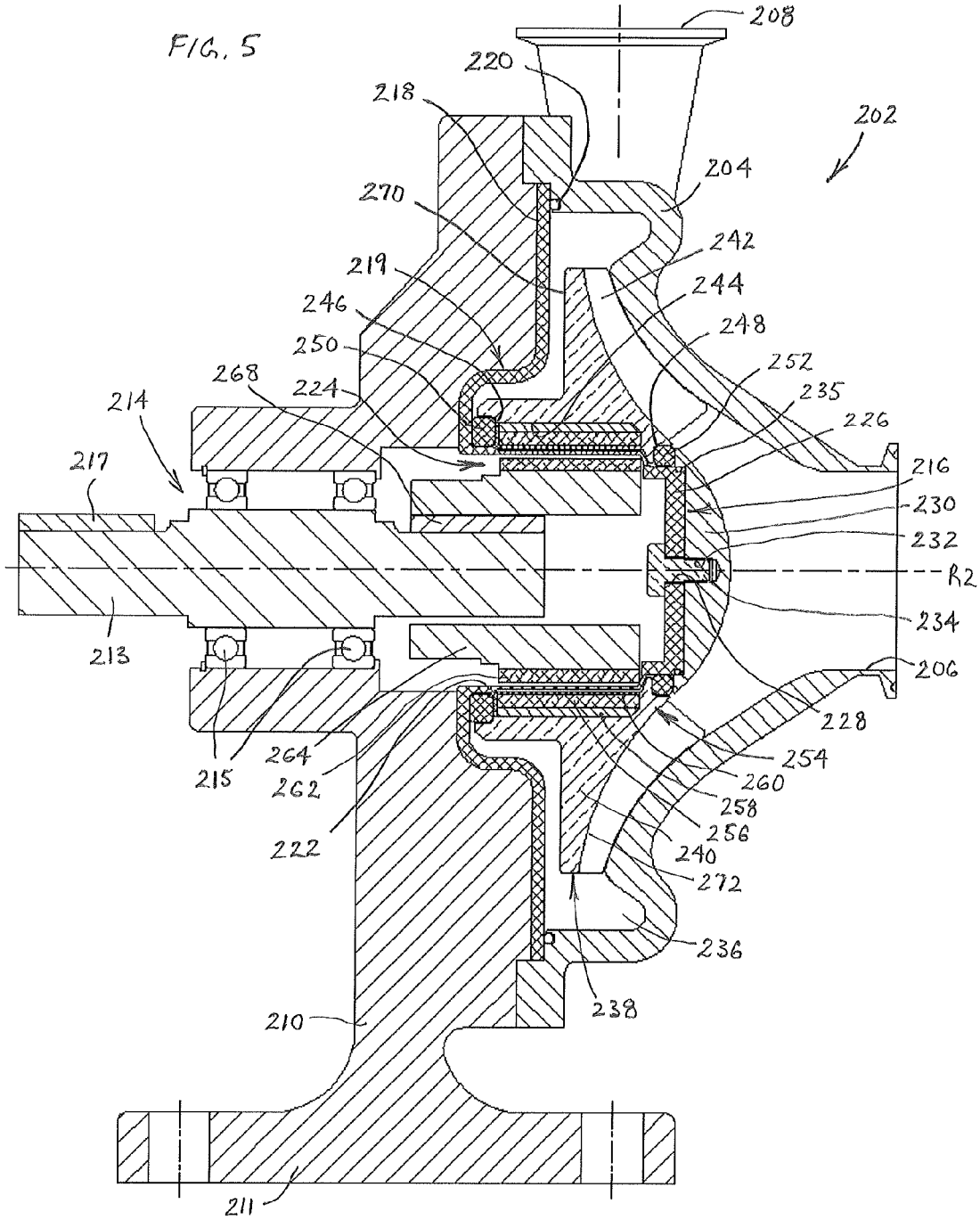
FIG. 5 is a cross-sectional view of a third example of a rotodynamic pump having a relatively long permanent magnet coupling within an impeller, with an inner drive having a long coupled shaft drive, mixed flow, a partial shroud, metallic fluid contact surfaces, and a canister of multi-part construction.

Turning to a third example embodiment in FIG. 5, a rotodynamic pump 202 includes a casing 204 with an inlet port 206, and an outlet port 208. The casing 204 may be constructed of rigid materials, such as were described for the first example, and the casing 204 may include a non-metallic liner or coating to provide non-metallic surfaces that contact the fluid that will flow through the pump, as shown within the second example.

The casing 204 is connected to an adapter 210, which includes a lower flange 211 that facilitates mounting the pump 202 to a base plate (not shown). The adapter 210 also accommodates a long-coupled drive configuration 214 via a coupling shaft 213 that is rotatably connected to the adapter 120 by bearings 215. It will be appreciated that the bearings 215 may be constructed as roller or ball bearings, as a bushing or in any other suitable form. Also, the coupling shaft 213 may be connected to a drive source, such as a drive motor, and the connection may be facilitated, for instance, by a key 217, or other suitable coupling structure.

Disposed in sealing engagement between the adapter 210 and the casing 204 is a canister 216 having a peripheral radial flange 218 that extends from a rear inverted cup portion 219 and is sealed to the casing 204 by a first static seal 220. The static seal 220 may be constructed in a similar manner to that described above with respect to the first example embodiment.

The canister 216 further includes a cylindrical portion 222 that has a rear opening 224, and a front end portion 226. The end portion 226 has a central aperture 228. The peripheral radial flange 218, inverted cup portion 219, cylindrical portion 222 and end portion 226 of the canister 216 may be constructed of any of a variety of rigid materials, and in any suitable manner, such as described above with respect to the first example embodiment. The canister 216 also may be integrally fabricated from a single piece or may be fabricated, such as by welding together separately formed portions. Much like in the first example, in this pump 202, a nose cone 230 has a threaded bore 232 that receives a fastener 234, such as a bolt, that passes through the aperture 228 in the end portion 226 of the canister 216 to connect the nose cone 230 to the canister 216. The nose cone 230 also is sealed to the canister 216 by a second static seal 235 that may be of similar construction to the first static seal 220.

The casing 204, the canister 216 and the nose cone 230 define an interior pumping cavity 236 that is in communication with the inlet port 206 and outlet port 208. An impeller 238 is disposed within the interior pumping cavity 236 and includes an impeller body 240 and vanes 242 extending therefrom. The impeller 238 has a partially shrouded construction and provides mixed axial and radial flow. It is desirable for the impeller 238 to have some form of thrust bearing surfaces. The impeller body 240 has a central opening 244 that includes a rear well 246 that together with an overlying magnet protection sleeve 260, discussed below, provides first axial and radial thrust bearing surfaces, and a front well 248 that provides second axial and radial thrust bearing surfaces. The first well 246 receives a rear bushing 250 and the second well 248 receives a front bushing 252. As noted with the prior examples, additional provision for rearward and/or forward thrust bearings also may be employed, and thrust bearings may be integrally or separately provided to retain appropriate positioning of components to reduce vibration and wear. In this third example, the impeller 238 is rotatably coupled to the canister 216 via the bushings 250, 252, that engage the thrust bearing surfaces provided by the rear and front wells 246, 248, and the impeller 238 rotates about a rotational axis R2. As noted above, alternative bushing configurations may be utilized and the bushings could be initially fixed to or otherwise engage the canister 216 or the impeller 238 during assembly of the pump 202.

To drive the impeller 238 in this third example pump 202, a permanent magnet coupling 254 is disposed within the central opening 244. The permanent magnet coupling 254 includes outer permanent magnets 256 connected to an outer magnet ring 258 that preferably is constructed of magnetic material and is disposed in the central opening 244 and connected to the impeller 238. Outer magnets 256 may be of any configuration, but are preferably rectangular and are preferably connected to the outer magnet ring 258 in a manner such as described with respect to the first example embodiment. The magnets 256 also may be protected from the pumped fluid by a thin magnet protection sleeve 260 that similarly to the prior examples provides protection in both the axial and radial directions. The outer magnets 256 are at least partially axially aligned with the pumping region of the impeller 238.

The permanent magnet coupling 254 further includes inner permanent magnets 262 connected to an inner magnet ring 264 that is in the configuration of a hub that is connected to the coupling shaft 213 by a key 268. The inner magnets 262 are in close proximity to, axially aligned with, but separated from the outer magnets 256 by the relatively thin-walled cylindrical portion 222 of the canister 216. When the coupling shaft 213 is connected to a power source, such as a drive motor, and is rotatably driven, it causes the inner magnets 262 to rotate which, via a magnetic coupling with the outer magnets 256, causes the impeller 238 to rotate.

As seen in FIG. 5, the impeller 238 has a rear surface 270 that is exposed to the discharged fluid that is under pressure. The forward thrust load generated by the discharge pressure on the rear surface 270 is at least partially balanced by the pressure of the fluid entering the inlet port 206 and engaging the front surface 272 of the impeller 238. As with the prior examples, the forward and rearward thrust loads on the impeller 238 may be balanced to a preselected degree. In turn, fluid under the higher discharge pressure is used in a circulation path to cool the canister 216, bushings 250, 252, and magnets 256, 262. The circulation path includes four sections, the first being a chamber behind the rear surface 270 of the impeller 238 through which fluid flows under pressure. The fluid flows from the first section to the second, which is formed by the rear bushing 250 having grooves, such as are shown in FIG. 3 in the rear bushing 50 of the first example embodiment. The fluid further flows through the third section of the circulation path which includes the gap between the cylindrical portion 222 of the canister 216 and the protection sleeve 260 over the outer magnets 256. The fluid then flows through the fourth section, which is formed by the front bushing 252 having grooves, again such as those shown with respect to the aforementioned rear bushing 50 of the first example. The fluid then flows out from around the nose cone 230 and rejoins the fluid entering the pumping cavity 236 through the inlet port 206. Thus, the rear and front bushings 250, 252 are of a similar configuration to the rear bushing of the first example, shown in a perspective view in FIG. 3. Still further cooling is promoted by the fluid entering the inlet port 206 and engaging the nose cone 230 that is connected to the front end portion 226 of the canister 216.

Unlike the first and second example pumps 2, 102, in this third example pump 202, the long-coupled drive configuration using a coupling shaft 213, connection of the inner magnet ring 264 to the coupling shaft 213, and the inverted cup portion 219 still allow for a shorter length, more space efficient and lighter weight, drive and pump installation. This greater space efficiency is achieved by allowing for a longer magnet coupling 254 that may be provided for higher torque applications, while still locating at least a portion of the magnet coupling 254 and magnets 256, 262 within the pumping region of the impeller 238, generally in a pumping plane that is perpendicular to the rotational axis R2 of the impeller 238.

From the above disclosure, it will be apparent that pumps constructed in accordance with this disclosure may include a number of structural aspects that cause them to provide a magnet coupling inside an impeller that is disposed within a pumping plane, such that the magnet coupling is at least partially axially aligned with the pumping region of the impeller. The pumps may exhibit one or more of the above-referenced potential advantages, depending upon the specific design choices made in constructing the pump.

It will be appreciated that a rotodynamic pump with permanent magnet coupling inside the impeller in accordance with the present disclosure may be provided in various configurations. Any variety of suitable materials of construction, configurations, shapes and sizes for the components and methods of connecting the components may be utilized to meet the particular needs and requirements of an end user. It will be apparent to those skilled in the art that various modifications can be made in the design and construction of such pumps without departing from the scope or spirit of the claimed subject matter, and that the claims are not limited to the preferred embodiments illustrated herein. It also will be appreciated that the example embodiments are shown in simplified form, so as to focus on the pumping principles and to avoid including structures that are not necessary to the disclosure and that would over complicate the drawings.

What is claimed is:

1. A rotodynamic pump having an inner drive permanent magnet coupling disposed inside of an impeller comprising:
- a pump casing defining a pumping cavity;
- an inlet port connected to the pumping cavity;
- an outlet port connected to the pumping cavity;
- an impeller being rotatable about a rotational axis and disposed within the pumping cavity and having vanes;
- the impeller having a pumping region generally defined by an axial length of the vanes;
- a permanent magnet coupling that rotatably drives the impeller and that includes outer magnets that are connected to the impeller and inner magnets that are connected to an inner magnet ring and are aligned with the outer magnets;
- the pumping region being at least partially aligned with the permanent magnet coupling such that an imaginary plane that is perpendicular to the rotational axis of the impeller is able to pass through the pumping region and at least a portion of the permanent magnet coupling;
- a canister that is sealed to the casing and separates the outer magnets from the inner magnets;
- a nose cone connected to a front end portion of the canister, wherein the nose cone is sealed to the front end portion of the canister by a static seal; and
- wherein the inlet port directs fluid flow axially relative to the impeller and fluid is discharged radially from the impeller to the outlet port.

2. A rotodynamic pump having an inner drive permanent magnet coupling disposed inside an impeller in accordance with claim 1, wherein the impeller includes a central opening that receives the outer magnets and a generally cylindrical portion of the canister.

3. A rotodynamic pump having an inner drive permanent magnet coupling disposed inside an impeller in accordance with claim 1, wherein all of the permanent magnet coupling is aligned with the pumping region of the impeller.

4. A rotodynamic pump having an inner drive permanent magnet coupling disposed inside an impeller in accordance with claim 1, wherein the impeller provides axial, radial or mixed flow.

5. A rotodynamic pump having an inner drive permanent magnet coupling disposed inside an impeller in accordance with claim 1, wherein the impeller includes no shroud, a partial shroud or a full shroud.

6. A rotodynamic pump having an inner drive permanent magnet coupling disposed inside an impeller in accordance with claim 1, wherein the inner magnet ring is coupled to a drive source configured as being of the close-coupled or long-coupled type.

7. A rotodynamic pump having an inner drive permanent magnet coupling disposed inside an impeller in accordance with claim 1, wherein the inner magnet ring is coupled to a drive source that is a motor.

8. A rotodynamic pump having an inner drive permanent magnet coupling disposed inside an impeller in accordance with claim 6, wherein the long-coupled type of drive includes a coupled shaft that is supported by bearings.

9. A rotodynamic pump having an inner drive permanent magnet coupling disposed inside an impeller in accordance with claim 1, wherein interior surfaces of the pump that contact fluid flowing through the pump are metallic or non-metallic.

10. A rotodynamic pump having an inner drive permanent magnet coupling disposed inside an impeller in accordance with claim 1, wherein interior surfaces within the pump have a surface finish that is for hygienic applications.

11. A rotodynamic pump having an inner drive permanent magnet coupling disposed inside an impeller in accordance with claim 1, wherein a protective sleeve is disposed between the outer magnets and the canister.

12. A rotodynamic pump having an inner drive permanent magnet coupling disposed inside an impeller in accordance with claim 11, wherein the protective sleeve provides axial and radial protection of the outer magnets.

13. A rotodynamic pump having an inner drive permanent magnet coupling disposed inside an impeller in accordance with claim 1, wherein the canister includes a peripheral flange.

14. A rotodynamic pump having an inner drive permanent magnet coupling disposed inside an impeller in accordance with claim 13, wherein the peripheral flange of the canister is sealed to the pump casing by a static seal.

15. A rotodynamic pump having an inner drive permanent magnet coupling disposed inside an impeller in accordance with claim 1, wherein the canister includes a cylindrical portion.

16. A rotodynamic pump having an inner drive permanent magnet coupling disposed inside an impeller in accordance with claim 1, wherein the canister includes an inverted cup portion connected to a cylindrical portion.

17. A rotodynamic pump having an inner drive permanent magnet coupling disposed inside an impeller in accordance with claim 1, wherein the nose cone that is connected to the front end portion of the canister is disposed within a path of fluid that flows through the inlet port and into the pumping cavity.

18. A rotodynamic pump having an inner drive permanent magnet coupling disposed inside an impeller in accordance with claim 1, wherein the canister is of multi-part or single piece construction.

19. A rotodynamic pump having an inner drive permanent magnet coupling disposed inside an impeller in accordance with claim 1, wherein forward and rearward thrust loads on the impeller are balanced to a preselected degree.

20. A rotodynamic pump having an inner drive permanent magnet coupling disposed inside an impeller in accordance with claim 1, wherein the pump includes a circulation path that allows pressurized discharge fluid to flow past the canister, toward the inlet port and into the pumping cavity.

21. A rotodynamic pump having an inner drive permanent magnet coupling disposed inside an impeller in accordance with claim 20, wherein the pump includes at least one thrust bushing having a configuration that allows fluid to pass by the thrust bushing.

22. A rotodynamic pump having an inner drive permanent magnet coupling disposed inside an impeller in accordance with claim 21, wherein the at least one thrust bushing includes grooves that allow fluid to pass by the thrust bushing.

* * * * *